US009506470B2

(12) United States Patent
Ginies et al.

(10) Patent No.: US 9,506,470 B2
(45) Date of Patent: Nov. 29, 2016

(54) SCROLL REFRIGERATION COMPRESSOR

(71) Applicant: DANFOSS COMMERCIAL COMPRESSORS, Reyrieux, Trevoux (FR)

(72) Inventors: Pierre Ginies, Sathonay Village (FR); Dominique Gross, Jassans Riottier (FR); Christophe Ancel, Villefranche sur Saone (FR); Yves Rosson, Villars les Dombes (FR); Philippe Dugast, Saint Bernard (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 236 days.

(21) Appl. No.: 13/690,833

(22) Filed: Nov. 30, 2012

(65) Prior Publication Data

US 2013/0136642 A1 May 30, 2013

(30) Foreign Application Priority Data

Nov. 30, 2011 (FR) ..... 11 60981
Nov. 30, 2011 (FR) ..... 11 60982

(51) Int. Cl.
*F16K 15/14* (2006.01)
*F16K 15/06* (2006.01)
(Continued)

(52) U.S. Cl.
CPC ..... *F04C 29/124* (2013.01); *F04C 23/008* (2013.01); *F04C 29/126* (2013.01); *F04C 18/0207* (2013.01)

(58) Field of Classification Search
CPC .. F04C 23/008; F04C 29/124; F04C 29/126; F04C 18/0207
USPC ..... 418/55.1–55.6, 57, 270; 137/527–527.8, 512.1, 515.7, 484, 137/247.19, 854
See application file for complete search history.

(56) References Cited

U.S. PATENT DOCUMENTS 2,090,486 A 8/1937 Richardson
2,754,844 A * 7/1956 Blackford ..... 137/514
(Continued)

FOREIGN PATENT DOCUMENTS

DE 10 2004 037 419 B3 2/2006
EP 1 653 080 A1 5/2006
(Continued)

OTHER PUBLICATIONS

French Search Report issued in French Application No. 1160981 dated Jul. 13, 2012 (w/translation).
(Continued)

*Primary Examiner* — Kenneth Bomberg
*Assistant Examiner* — Deming Wan
(74) *Attorney, Agent, or Firm* — Oliff PLC

(57) ABSTRACT

The scroll refrigeration compressor according to the invention includes a sealed enclosure at least partially defining a discharge chamber designed to be connected to a discharge line, and a discharge valve attached on the sealed enclosure and fluidly connected to the discharge chamber. The discharge valve includes a valve body, a valve seat, and a discharge check valve movable between a covering position and a released position. The discharge valve includes deflection means positioned in the valve body and arranged to orient the flow of refrigerant coming from the discharge line at least partially toward the periphery of the discharge check valve.

12 Claims, 5 Drawing Sheets

(51) Int. Cl.

| | |
|---|---|
| ***F16K 17/04*** | (2006.01) |
| ***F01C 1/02*** | (2006.01) |
| ***F01C 1/063*** | (2006.01) |
| ***F03C 2/00*** | (2006.01) |
| ***F04C 2/02*** | (2006.01) |
| ***F04C 29/12*** | (2006.01) |
| ***F04C 23/00*** | (2006.01) |
| *F04C 18/02* | (2006.01) |

(56) References Cited

U.S. PATENT DOCUMENTS

| | | | | |
|---|---|---|---|---|
| 3,002,528 | A * | 10/1961 | Leissner | F04B 53/1015 137/539 |
| 4,700,741 | A * | 10/1987 | Murphy | F16K 15/044 137/539 |
| 4,896,695 | A * | 1/1990 | Pysh | 137/512.1 |
| 5,469,884 | A * | 11/1995 | Madrid | 137/515.7 |
| 5,794,657 | A | 8/1998 | Oberg | |
| 6,132,191 | A | 10/2000 | Hugenroth et al. | |
| 6,171,084 | B1 * | 1/2001 | Wallis et al. | 418/55.1 |
| 6,190,144 | B1 | 2/2001 | Balma | |
| 6,220,282 | B1 * | 4/2001 | Powell | 137/512 |
| 6,648,010 | B1 * | 11/2003 | Goodwin | 137/493.1 |
| D576,704 | S * | 9/2008 | Gilcher | D23/233 |
| 7,721,757 | B2 | 5/2010 | Ginies et al. | |
| 2005/0238518 | A1 * | 10/2005 | Ginies et al. | 417/559 |
| 2006/0140797 | A1 | 6/2006 | Nam | |
| 2008/0023079 | A1 | 1/2008 | Dickenscheid et al. | |
| 2009/0110581 | A1 | 4/2009 | Fontaine et al. | |

FOREIGN PATENT DOCUMENTS

| | | |
|---|---|---|
| FR | 1.486.302 | 6/1967 |
| JP | A-2006-125374 | 5/2006 |
| WO | WO 2007/114582 A1 | 10/2007 |

OTHER PUBLICATIONS

French Search Report issued in French Application No. 1160982 dated Jul. 12, 2012 (w/translation).

* cited by examiner

SCROLL REFRIGERATION COMPRESSOR

The present invention relates to a scroll refrigeration compressor.

Document U.S. Pat. No. 7,721,757 discloses a scroll refrigeration compressor, having a sealed enclosure delimiting a suction chamber and a discharge chamber separated by a compression stage comprising a stationary volute and a moving volute driven in an orbital movement. The compressor also has a discharge valve fixed on the sealed enclosure and fluidly connected to the discharge chamber, the discharge valve comprising:

- a valve body,
- a valve seat,
- a discharge check valve movable between a covering position, in which the discharge check valve bears against the valve seat, and a released position, in which the discharge check valve is remote from the valve seat,
- a return member arranged to return the discharge check valve to its covering position, and
- a support member positioned in the valve body and arranged to support the return means and the discharge check valve and to guide the discharge check valve between its covering and released positions.

Such a discharge valve makes it possible to prevent high-pressure refrigerant from returning to the discharge chamber, which could cause a reversed movement detrimental to the moving volute when the compressor is stopped.

However, when high-pressure refrigerant returns toward the discharge check valve, the latter may collide with the valve seat violently, which could damage the valve seat and the discharge check valve, and therefore lead to leaks that could affect the reliability of the compressor.

Furthermore, as a function of the operating conditions of the compressor, turbulence may appear at the rear of the discharge check valve, which could lead to repeated movements of the discharge check valve of a nature to cause premature wear of the discharge valve and chattering.

Moreover, when the compressor incorporating such a discharge valve is a variable speed compressor, the stability of the discharge check valve may be greatly affected by the low-speed operation of the compressor.

The present invention aims to resolve these drawbacks.

The technical problem at the base of the invention therefore consists of providing a scroll refrigeration compressor having a discharge valve with a simple, cost-effective and reliable structure.

To that end, the present invention relates to a scroll refrigeration compressor, comprising a sealed enclosure at least partially delimiting the discharge chamber designed to be connected to a discharge line, and a discharge valve attached on the sealed enclosure and fluidly connected to the discharge chamber, the discharge valve comprising:

- a valve body,
- a valve seat,
- a discharge check valve movable between a covering position, in which the discharge check valve bears against the valve seat, and a released position, in which the discharge check valve is remote from the valve seat,
- guide means positioned in the valve body and arranged to guide the discharge check valve between its covering and released positions, characterized in that the discharge valve comprises deflection means positioned in the valve body and arranged to orient the flow of refrigerant coming from the discharge line at least partially toward the periphery of the discharge check valve, and in that the guide means include at least first and second metal parts each comprising a substantially planar assembly portion, the assembly portions being assembled to one another, the first and second metal parts delimiting a housing arranged to house the discharge check valve.

Thus, in the event of a return of high-pressure refrigerant coming from the discharge line, a significant portion of the refrigerant is deviated toward the periphery of the discharge check valve by the deflection means. The deflection means then make it possible to avoid a direct impact of a significant portion of the refrigerant at the rear of the discharge check valve, and therefore to limit the movement speed of the discharge check valve toward its covering position. This results in a significant decrease in the violence of the impact of the discharge check valve against the valve seat. These arrangements make it possible on the one hand to preserve the integrity of the discharge check valve and the valve seat, and to thereby improve the reliability of the discharge valve, and on the other hand to decrease the noise generated by the discharge valve when the latter part is closed.

Furthermore, the deflection means make it possible to limit the appearance of turbulence at the rear of the discharge check valve, and therefore to limit the wear of the discharge valve and decrease the noise generated by the latter during operation.

Furthermore, making the guide means from two metal parts makes it possible to greatly simplify the manufacture of the discharge valve, since the guide means can be obtained easily and quickly by cutting out the sheet metal so as to form to metal parts, and dissembling said parts. This results in a significant decrease in the manufacturing costs of the discharge valve.

Furthermore, making the guide means from two metal parts makes it possible to limit pressure losses of the discharge valve, and therefore to improve the performance of the compressor.

The deflection means are advantageously positioned opposite the valve seat relative to the discharge check valve. For example, the deflection means extend substantially parallel to the discharge check valve.

Preferably, the deflection means and the discharge check valve are positioned substantially coaxial. The deflection means advantageously extend transverse to the axis of the discharge valve.

Preferably, the deflection means and the valve body delimit at least one peripheral flow passage. According to one embodiment of the invention, the deflection means and the valve body delimit a plurality of peripheral flow passages distributed around the deflection means. According to another embodiment of the invention, the deflection means and the valve body delimit an annular peripheral flow passage.

Preferably, the deflection means delimit an obstruction section corresponding to approximately at least 30% of the obstruction section of the discharge check valve, and for example approximately at least 50%, or at least 70% of the obstruction section of the discharge check valve. According to one embodiment, the deflection means delimit an obstruction section substantially corresponding to that of the discharge check valve.

According to one feature of the invention, the deflection means include at least one axial stop surface against which the discharge check valve can bear in the released position.

According to one embodiment of the invention, the valve body delimits a passage opening, the valve seat being formed on the valve body around the passage opening.

According to another embodiment of the invention, the discharge valve includes a stop member mounted on the valve body and delimiting a passage opening, the valve seat being formed on the stop member around the passage opening. These arrangements make it possible to produce the valve seat and the valve body independently, which makes it possible to obtain a different surface state between the valve seat and the valve body easily.

According to one embodiment of the invention, the first and second metal parts are arranged to bear against the stop member.

According to one embodiment of the invention, the deflection means are mounted on the guide means. The deflection means can thus for example be fastened on the guide means or be integral therewith.

The assembly portions are preferably assembled to one another so as to have a substantially cross-shaped transverse section.

According to one embodiment of the invention, the first and second metal parts have a substantially identical outer profile. These arrangements make it possible to cut the first and second metal parts using a same cutting tool, which makes it possible to further simplify the manufacture of the discharge valve.

Preferably, at least one of the first and second metal parts has at least one flap extending from the respective assembly portion, the at least one flap forming the deflection means. Each of the first and second metal parts advantageously has two flaps extending from the respective assembly portion and opposite one another, the flaps of the first and second metal parts forming the deflection means.

Each flap preferably extends substantially parallel to the discharge check valve, more particularly substantially perpendicular to the corresponding assembly portion.

Advantageously, the assembly portion of each of the first and second metal parts has a first edge turned toward the discharge check valve and the second edge opposite the first edge. According to one embodiment of the invention, each flap extends from the first edge of the respective assembly portion. According to another embodiment of the invention, each flap extends from the second edge of the respective assembly portion.

The various flaps are preferably arranged to form a substantially disk-shaped deflection screen.

According to one embodiment of the invention, the valve body has an axial stop surface against which each of the first and second metal parts is intended to bear, and preferably the assembly portion of each of the first and second metal parts. According to one feature of the invention, the second edge of the assembly portion of each of the first and second metal parts is designed to bear against the axial stop surface formed on the valve body.

According to one embodiment of the invention, the assembly portions of the first and second metal parts extend substantially parallel to the longitudinal axis of the discharge valve.

Preferably, the axis of intersection of the assembly portions of the first and second metal parts is substantially parallel to, advantageously substantially combined with, the longitudinal axis of the discharge valve.

According to one embodiment of the invention, the assembly portions of the first and second metal parts extend substantially perpendicular to one another.

Advantageously, each of the first and second metal parts has two lateral branches extending from the respective assembly portion arranged to guide the discharge check valve between its covering and released positions. Each lateral branch preferably has at least one first substantially planar portion extending from the respective assembly portion. The first portion of each lateral branch for example extends substantially parallel to the respective assembly portion, and more particularly in the plane of the respective assembly portion.

According to one embodiment of the invention, each lateral branch has a guide portion extending from an inner edge of the first respective portion, each guide portion being arranged to guide the discharge check valve between its covering and released positions. Each guide portion may for example be substantially planar and for example extend substantially perpendicular to the first respective portion. Each guide portion may for example be sintered substantially in an arc of circle.

Preferably, the lateral branches of the first and second metal parts are arranged to bear against the stop member.

The stop member may for example have an annular groove extending around the valve seat arranged to receive end portions of the lateral branches. According to one embodiment of the invention, each lateral branch has a second portion extending in the extension of the first respective portion, the second portion of each lateral branch being arranged to be received in the annular groove of the stop member. According to one embodiment of the invention, the inner edge of the second portion of each lateral branch extends in the continuation of the inner edge of the first respective portion. The second portion of each lateral branch preferably has a width smaller than that of the first respective portion.

According to one feature of the invention, the valve body has a tubular assembly portion on which the stop member is mounted. The first and second metal parts are advantageously configured to be inserted into the valve body through the mounting portion of the valve body before mounting of the stop member on said mounting portion.

According to one embodiment of the invention, each assembly portion has at least one assembly notch, the assembly notches being arranged to allow the assembly of the assembly portions. Advantageously, the assembly portion of the first metal part has a first assembly notch, and the assembly portion of the second metal part has a second assembly notch, the first and second assembly notches being arranged to allow the assembly of the assembly portions of the first and second metal parts.

According to one embodiment of the invention, one of the first and second assembly notches emerges in the first edge of the respective assembly portion, and the other of the first and second assembly notches emerges in the second edge of the respective assembly portion. Preferably, the first and second assembly notches have substantially identical dimensions, and more particularly substantially identical widths and substantially identical depths, the width of each notch corresponding substantially to the thickness of the metal parts.

According to another embodiment of the invention, the guide means have at least one axial stop surface against which the discharge check valve can bear in the released position. Each of the first and second metal parts for example has at least one axial stop surface against which the discharge check valve can bear in the released position. The assembly portion of each of the first and second metal parts for example has an axial stop surface against which the discharge check valve can bear in the released position. Each axial stop surface of the discharge check valve is then advantageously formed on the first edge of the respective assembly portion.

According to one embodiment of the invention, the guide means have at least one third metal part comprising a substantially planar assembly portion, the assembly portions being assembled to one another so as to have a substantially polygon-shaped transverse section, for instance a triangle.

According to one embodiment of the invention, the deflection means have a deflection screen. The deflection screen may be formed by a conical or flat washer. The deflection screen may also have a bowl shape, the cavity of which is oriented toward the discharge check valve. The deflection screen may also be substantially disk-shaped.

The annular flow passage is advantageously delimited by the inner wall of the valve body and the outer peripheral edge of the deflection screen.

According to one embodiment of the invention, the discharge check valve is generally disk-shaped.

Advantageously, the discharge valve comprises return means arranged to return the discharge check valve to its covering position. According to one embodiment of the invention, the guide means have at least one axial bearing surface for the return means. For example, each of the first and second metal parts has at least one axial bearing surface against which the return means are intended to bear. According to one embodiment of the invention, each assembly portion of the first and second metal parts has at least one axial bearing surface against which the return means are intended to bear. The assembly portion of each of the first and second metal parts may for example have two axial bearing surfaces against which the return means are intended to bear. Each axial bearing surface is advantageously formed on the first edge of the respective assembly portion.

According to another embodiment of the invention, the deflection means have at least one axial bearing surface for the return means. According to one embodiment of the invention, each flap of the first and second metal parts forms an axial bearing surface for the return means.

According to one embodiment of the invention, the guide means are arranged to support the return means.

According to one embodiment of the invention, the return means have a helical spring. The helical spring may for example have flat turns.

According to one embodiment of the invention, the assembly portion of each of the first and second metal parts has two recesses arranged to receive the return means, the bottom of each recess forming an axial bearing surface for the return means.

According to one embodiment of the invention, the check valve is configured such that the discharge check valve, the valve seat, and the deflection means extend inside the discharge chamber.

According to one embodiment of the invention, the discharge valve is configured such that the discharge check valve, the valve seat, and the deflection means extend outside the sealed enclosure of the compressor.

The valve body may for example have a tubular connecting portion mounted in a discharge opening formed in the sealed enclosure, the discharge opening emerging in the discharge chamber.

In any event, the invention will be well understood using the following description in reference to the appended diagrammatic drawing showing, as non-limiting examples, several embodiments of this scroll refrigeration compressor.

Figure 1:
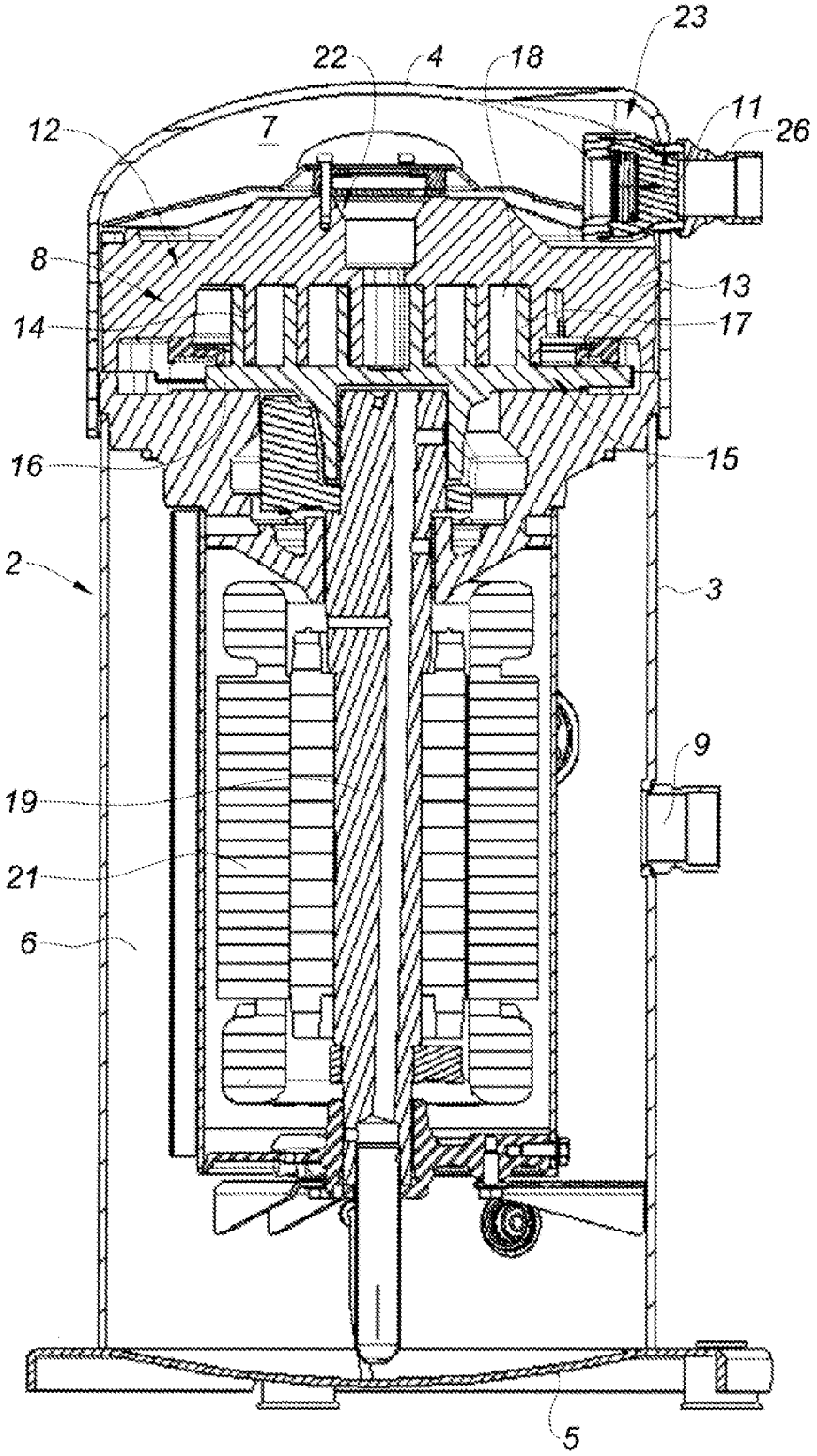
FIG. 1 is a longitudinal cross-sectional view of a scroll refrigeration compressor according to a first embodiment of the invention.

FIG. 1 describes a scroll refrigeration compressor in a vertical position. However, the compressor according to the invention may occupy an inclined position, or a horizontal position, without its structure being modified significantly.

The compressor shown in FIG. 1 comprises a sealed enclosure 2 delimited by a shroud 3 whereof the upper and lower ends are respectively a cover 4 and a base 5. The assembly of the sealed enclosure 2 may in particular be done using weld seams.

The sealed enclosure 2 delimits a low-pressure suction chamber 6 and a high-pressure discharge chamber 7 separated by a compression stage 8.

The sealed enclosure 2 comprises an intake orifice 9 emerging in the suction chamber 6 to bring refrigerant into the compressor, and a discharge orifice 11 emerging in the discharge chamber 7 to discharge the refrigerant outside the compressor.

The compression stage 8 comprises a stationary volute 12 having a plate 13 from which a stationary scroll 14 turned downward extends, and a moving volute 15 having a plate 16 from which a scroll 17 turned upward extends. The two scrolls 14 and 17 of the two volutes interpenetrate one another to form variable volume compression chambers 18. The compressor comprises a rotary driveshaft 19 arranged to drive the moving volute 15 in an orbital movement, and an electric motor 21 arranged to rotate the driveshaft 19.

During the orbital movement of the moving volute 15, the compression chambers 18 define a volume that gradually decreases from the periphery of the compression stage 8, where the refrigerant is admitted into the compression chambers 18, toward the center of the compression stage 8, where the compressed fluid exits toward the discharge chamber 7 via a discharge conduit 22 formed in the central portion of the stationary volute 12.

The compressor also comprises a discharge valve 23 fastened on the sealed enclosure 2 and fluidly connected to the discharge chamber 7.

The discharge valve 23 comprises a tubular valve body 24 delimiting a fluid flow passage. The valve body 24 comprises a connecting portion 25 mounted in the discharge orifice 11. The connecting portion 25 protrudes outside the sealed enclosure 2 and serves to mount a discharge connector 26 designed to connect the discharge line connected to a refrigeration or cooling system. The valve body 24 has a passage opening 27 emerging in the discharge chamber 7, and delimits a valve chamber 28.

The discharge valve 23 also comprises a valve seat 29 formed on the annular valve body 24 around the passage opening 27.

The discharge valve 23 also comprises a disc-shaped discharge check valve 31, the discharge check valve 31 being movable between a covering position, in which the discharge check valve 31 bears against the valve seat 29, and a released position (FIG. 2), in which the discharge check valve 31 is moved away from the valve seat 29.

The discharge valve 23 also comprises a return member 35 arranged to return the discharge check valve 31 toward its covering position. The return member 35 may for example be formed by a helical spring.

The discharge valve 23 also comprises a support member 36 arranged on the valve body 24 and arranged to support the return member 35 in the discharge check valve 31 and to guide the discharge check valve 31 between its covering and released positions. The discharge valve 23 is configured such that the support member 36, the discharge check valve 31, and the valve seat 29 extend inside the discharge chamber 7.

The support member 36 is formed by first and second metal parts 52, 53 defining a central housing 54 arranged to house the return member 35 and the discharge check valve 31. The first and second metal parts 52, 53 extend parallel to the longitudinal axis A of the discharge valve 23, and perpendicular relative to one another. Preferably, the axis of intersection between the first and second metal parts 52, 53 is combined with the longitudinal axis A of the discharge valve 23.

Each of the first and second metal parts 52, 53 has an assembly portion 55, 56 with a generally rectangular shape, and two substantially parallel lateral branches 57, 58 extending from the respective assembly portion and arranged to guide the discharge check valve 31 between its covering and released positions.

The assembly portion 55, 56 of each of the first and second metal parts 52, 53 has a first edge 55*a*, 56*a* turned toward the respective lateral branches and a second edge 55*b*, 56*b* opposite the first edge.

The assembly portions 55, 56 of the first and second metal parts 52, 53 are assembled to one another so as to have a substantially cross-shaped transverse section. In order to ensure such an assembly, the assembly portion 55 of the first metal part 52 has a first assembly notch 59 emerging in the second edge 55*b* of the assembly portion 55, and the assembly portion 56 of the second metal part 53 has a second assembly notch 61 emerging in the first edge 56*a* of the assembly portion 56.

Figure 2:
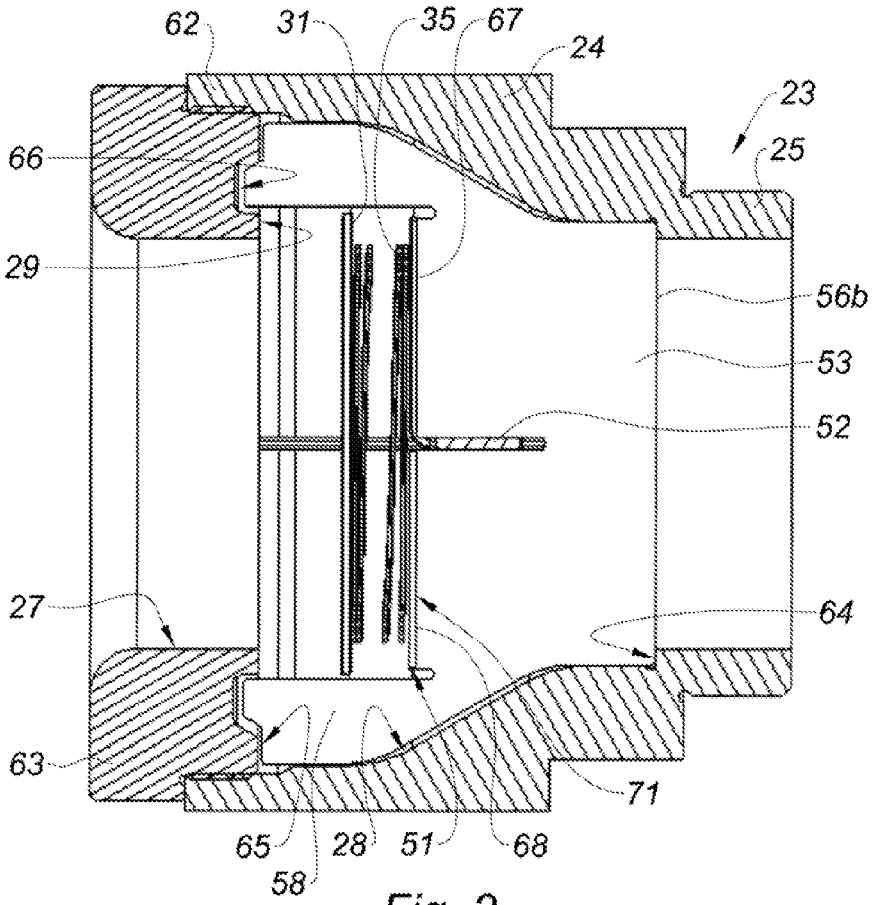
FIG. 2 is a cross-sectional view of a discharge valve of the compressor of FIG. 1.
Figure 3:
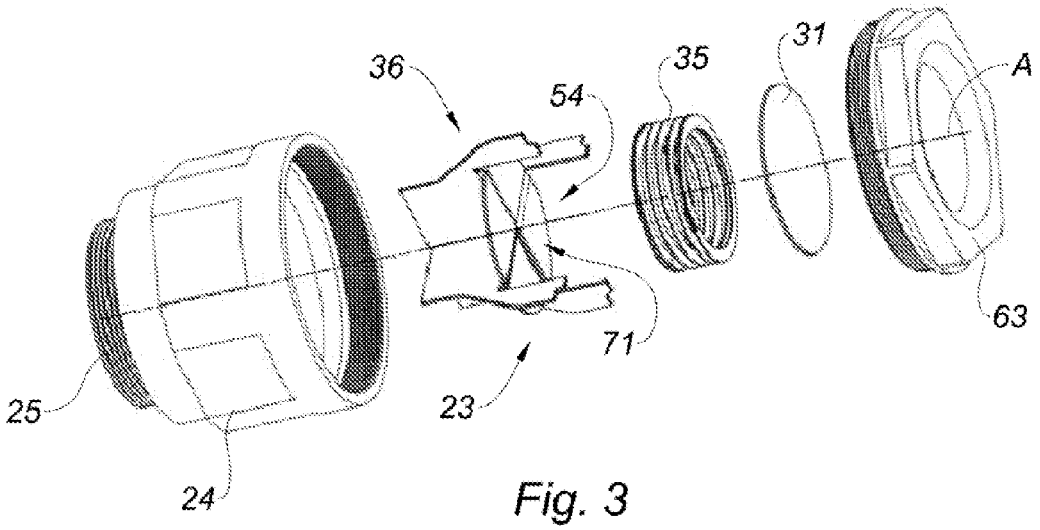
FIG. 3 is an exploded perspective view of the discharge valve of FIG. 2.
Figure 4:
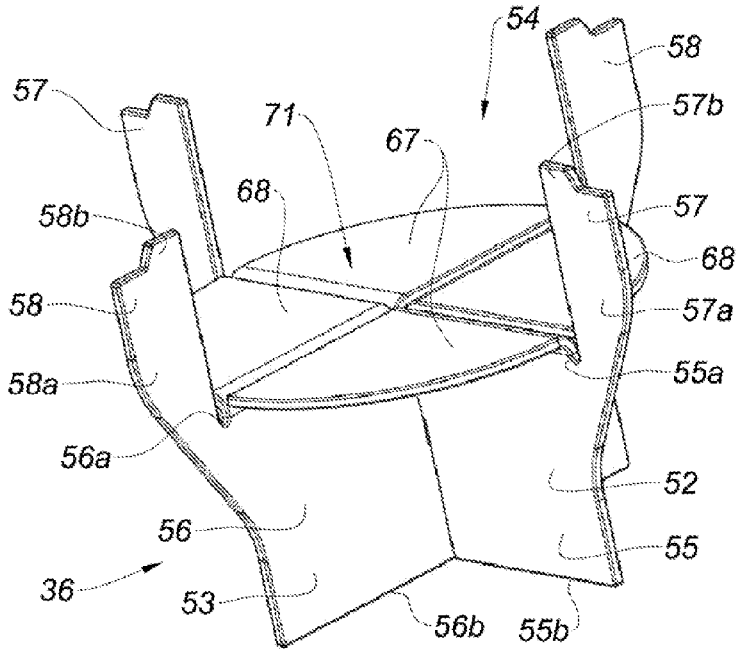
FIG. 4 is a perspective view of two metal parts assembled to one another belonging to the discharge valve of FIG. 2.
Figure 5:
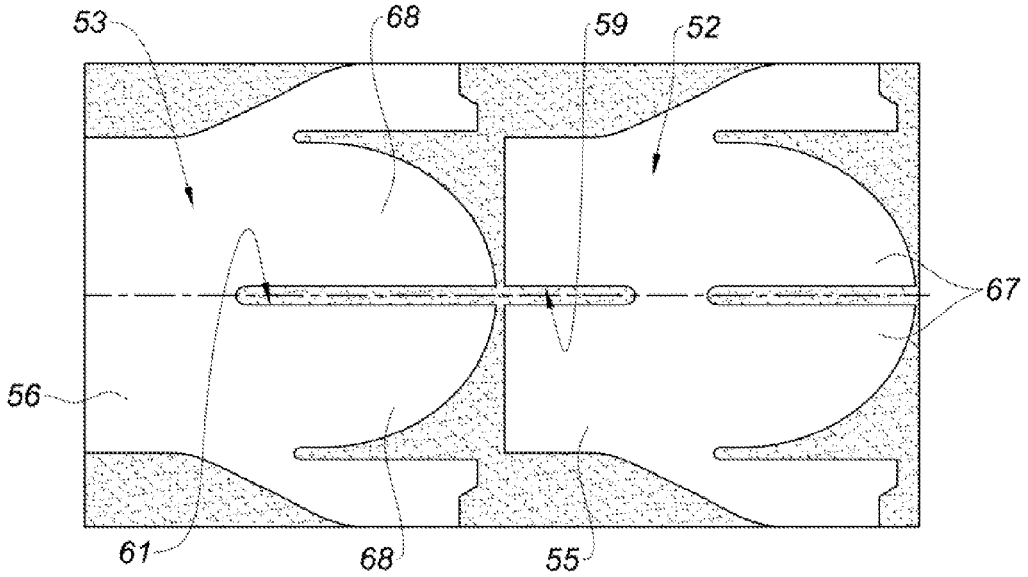
FIG. 5 is a top view of sheet metal during the cutting out of the two metal parts of FIG. 4.

As shown in FIG. 2, the first and second metal parts 52, 53 each have an outer profile complementary with the inner profile of the valve body 24.

The valve body 24 also has a mounting portion 62, opposite the connecting portion 25, on which an annular stop member 63 is mounted to limiting the passage opening 27 and on which the valve seat 29 is formed.

The first and second metal parts 52, 53 respectively bear on the one hand against the stop member 63, and on the other hand against the valve body 24. More particularly, the valve body 24 has an axial stop surface 64 (see FIG. 2) against which the second edge 55*b*, 56*b* of the assembly portion 55, 56 of each of the first and second metal parts 52 and 53 bears, and the stop member 63 has an axial stop surface 65 against which the lateral branches 57, 58 of the first and second metal parts bear.

Each lateral branch 57, 58 has a connecting portion 57*a*, 58*a*, extending from the respective assembly portion, and an end portion 57*b*, 58*b* extending in the extension of the respective connecting portion 57*a*, 58*a* and having a width smaller than that of the respective connecting portion. The end portion 57*b*, 58*b* of each lateral branch 57, 58 has a lower edge extending in the continuation of the lower edge of the respective connecting portion 57*a*, 58*a*. The stop member 63 advantageously has an annular groove 66 extending around the valve seat 29 and arranged to receive the end portions 57*b*, 58*b* of the lateral branches 57, 58.

Each of the first and second metal parts 52, 53 has two flaps 67, 68 extending from the first edge 55*a*, 56*a* of the respective assembly portion 55, 56 and opposite one another. The flaps 67, 68 of the first and second metal parts 52, 53 extend substantially perpendicular to the assembly portions 55, 56. Each flap 67, 68 is substantially in the shape of a quarter disk. Each flap 67, 68 of the first and second metal parts 52, 53 forms an axial bearing surface for the return member 35.

The discharge valve 23 lastly comprises deflection means arranged to orient the flow of refrigerant coming from the discharge line at least partially toward the periphery of the discharge check valve 31.

According to the embodiments shown in FIGS. 1 to 4, the deflection means are formed by the flaps 67, 68 of the first and second metal parts 52, 53. In fact, the flaps 67, 68 of the first and second metal parts 52, 53 form a substantially disk-shaped deflection screen 71. The deflection screen 71 the limits of obstruction section substantially corresponding to the obstruction section of the discharge valve 31. The deflection screen 71, the valve body 24, and the metal parts 52, 53 delimit a plurality of peripheral flow passages 51 distributed around the deflection screen 71.

The operation of the scroll compressor will now be described.

When the scroll compressor according to the invention is turned on, the moving volute 12 is driven by the driveshaft 19 following an orbital movement, this movement of the moving volute causing an intake and compression of refrigerant in the variable-volume compression chambers 18. This compressed refrigerant escapes to the center of the volutes through the discharge conduit 22, flows into the discharge chamber 7 and through the passage opening 27, moves the discharge check valve 31 into its released position against the return force exerted by the return member 35, then flows into the valve chamber 28 and through the flow passage 51 to the outside of the compressor.

When the scroll compressor according to the invention is stopped, the return member 35 stresses the discharge chamber 31 toward its covering position, which prevents high-pressure refrigerant from returning to the discharge chamber 7.

In the event of a return of high-pressure refrigerant toward the discharge check valve 31, the refrigerant is deviated toward the periphery of the covering portion of the discharge check valve 31 by the deflection screen 71. These arrangements must make it possible to limit the violence of the impact of the discharge check valve 31 against the discharge seat 29, and therefore to preserve the integrity of the discharge check valve 31 and the valve seat 29 over time.

Figure 6:
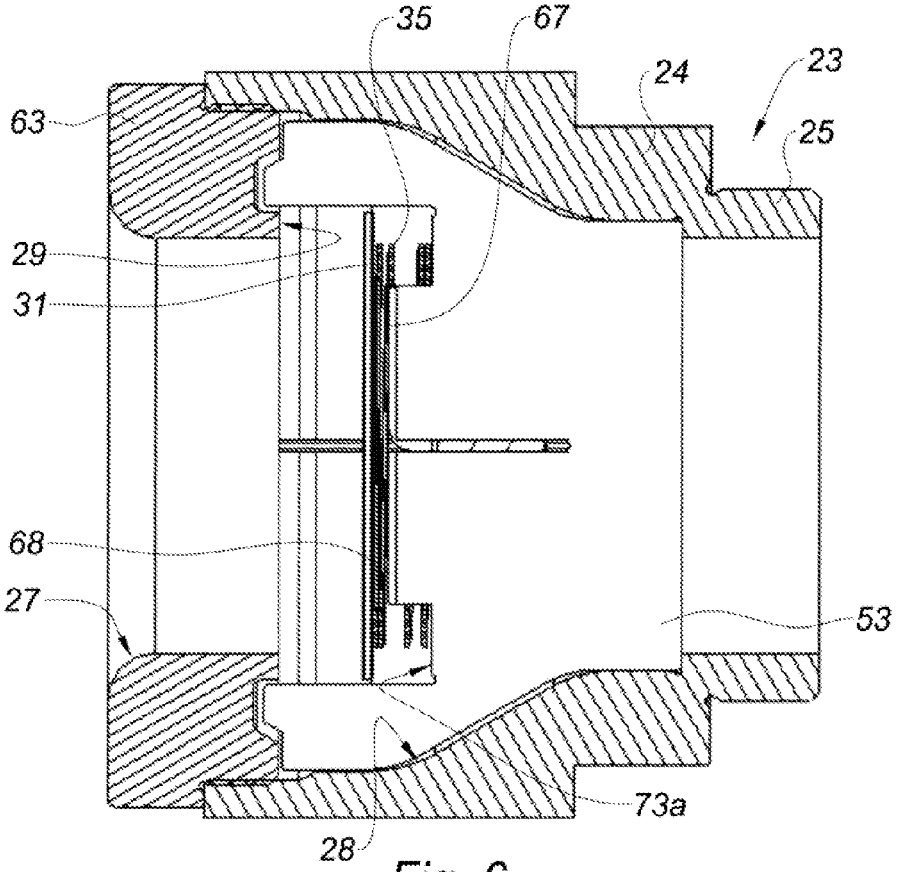
FIG. 6 is a cross-sectional view of a discharge valve according to a second embodiment of the invention, more particularly showing the check valve thereof the released position.
Figure 7:
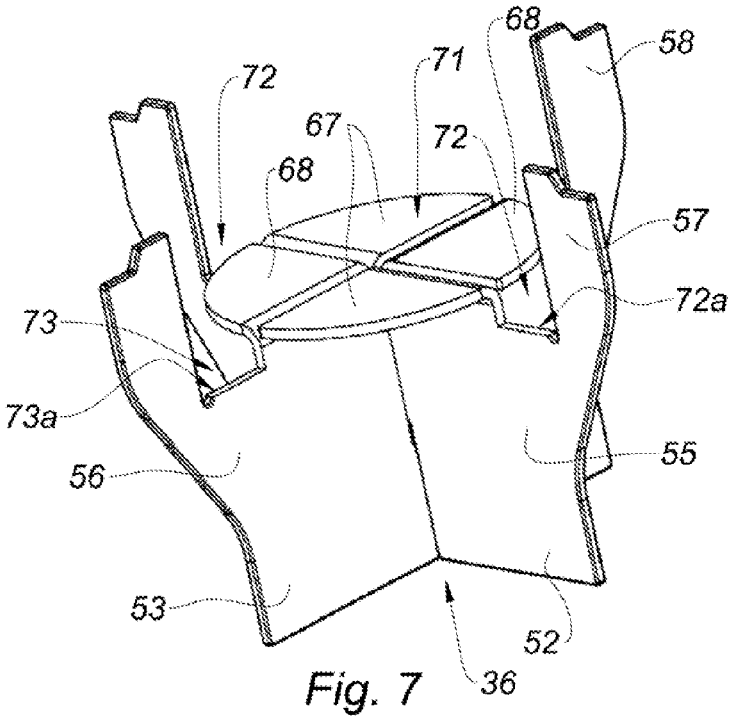
FIG. 7 is a perspective view of two metal parts assembled to one another belonging to the discharge valve of FIG. 6.

FIGS. 6 and 7 show a discharge valve 23 according to a second embodiment that differs from that shown in FIGS. 1 to 4 essentially in that the assembly portion 55, 56 of each of the first and second metal parts 52, 53 has two recesses 72, 73 emerging on the side of the lateral branches 57, 58 and arranged to receive the return member 35, the bottom of each recess 72, 73 forming an axial bearing surface 72*a*, 73*a* for the return member 35, and in that each flap 67, 68 forms an axial stop surface against which the discharge check valve 31 can bear in the released position.

Figure 8:
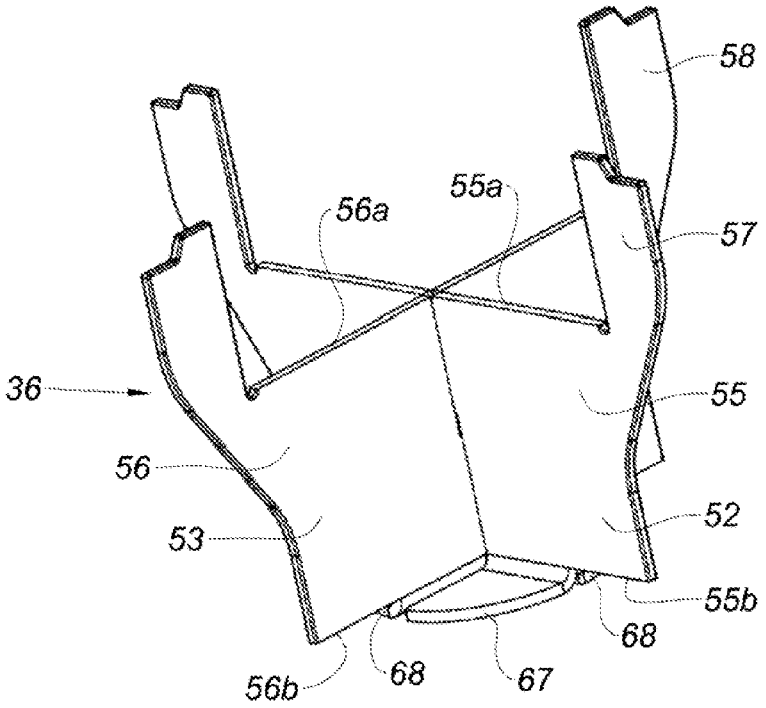
FIG. 8 is a perspective view of two metal parts assembled to one another belonging to a discharge valve according to a third embodiment of the invention.

FIG. 8 shows the first and second metal parts 52, 53 of the discharge valve according to a third embodiment that differs from that shown in FIGS. 1 to 4 essentially in that the flaps 67, 68 extend from the second edge 55*b*, 56*b* of the respective assembly portion 55, 56. According to this embodiment, the first edge 55*a*, 56*a* of the assembly portion 55, 56 of each of the first and second metal parts 52, 53 forms an axial bearing surface for the return member 35.

Figure 9:
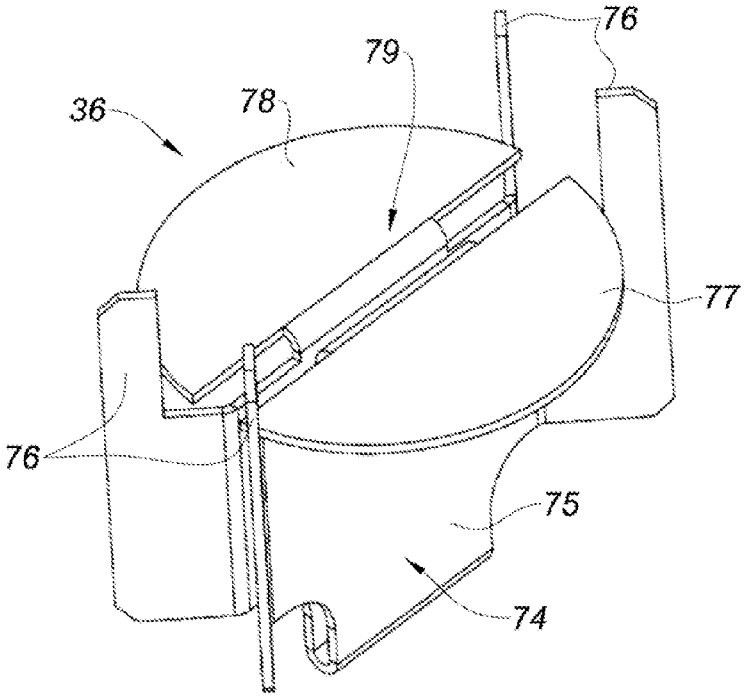
FIG. 9 is a perspective view of a metal part belonging to a discharge valve according to a fourth embodiment of the invention.

FIG. 9 shows a discharge valve according to a fourth embodiment that differs from that shown in FIGS. 1 to 4 essentially in that the support member 36 is formed by a metal part 74 folded on itself. The metal part 74 has a base portion 75 and four lateral branches 76 that extend from the base portion 75 and are arranged to guide the discharge check valve 31 between its covering and released positions.

The metal part 74 also has two flaps 77, 78 extending from an edge of the base portion 75 and opposite one another. The flaps 77, 78 extend substantially perpendicular to the base portion 75. Each flap 77, 78 is substantially in the shape of a half-disk. The flaps 77, 78 thus form a substantially disk-shaped deflection screen 79. According to this embodiment, each flap 77, 78 forms an axial bearing surface for the return member 35.

The invention is of course not limited solely to the embodiments of this scroll refrigeration compressor described above as examples, but on the contrary encompasses all alternative embodiments.

The invention claimed is:

1. A scroll refrigeration compressor, comprising a sealed enclosure at least partially delimiting a discharge chamber designed to be connected to a discharge line, and a discharge valve attached on the sealed enclosure and fluidly connected to the discharge chamber, the discharge valve comprising:

a valve body, a valve seat, a discharge check valve movable between a covering position, in which the discharge check valve bears against the valve seat, and a released position, in which the discharge check valve is remote from the valve seat, a guide device positioned in the valve body and configured to guide the discharge check valve between the covering position and the released position, the guide device including at least a first metal guide part and a second metal guide part respectively including a first assembly portion and a second assembly portion, the first assembly portion and the second assembly portion being substantially planar, the first assembly portion being attached to the second assembly portion, the first metal guide part and the second metal guide part delimiting a housing configured to house the discharge check valve, and a deflector element positioned in the valve body and opposite the valve seat relative to the discharge check valve, the deflector element being configured to orient a flow of refrigerant coming from the discharge line at least partially toward the periphery of the discharge check valve, wherein at least one of the at least first metal guide part and the second metal guide part has at least one flap extending from the respective one of the first assembly portion and the second assembly portion, the at least one flap being monolithically integral with the respective one of the first assembly portion and the second assembly portion, the at least one flap at least partially forming the deflector element, and wherein the first assembly portion is attached to the second assembly portion so that the first assembly portion and the second assembly portion have a cross-shaped transverse section.

2. The compressor according to claim 1, wherein the deflector element extends transverse to an axis (A) of the discharge valve.

3. The compressor according to claim 1, wherein the deflector element and the valve body delimit at least one peripheral flow passage.

4. The compressor according to claim 3, wherein the deflector element and the valve body delimit a plurality of peripheral flow passages distributed around the deflector element.

5. The compressor according to claim 3, wherein the deflector element and the valve body delimit an annular peripheral flow passage.

6. The compressor according to claim 1, wherein the deflector element delimits an obstruction section corresponding to approximately at least 30% of an obstruction section of the discharge check valve.

7. The compressor according to claim 1, wherein the deflector element includes at least one axial stop surface against which the discharge check valve can bear in the released position.

8. The compressor according to claim 1, wherein the deflector element is mounted on the guide device.

9. The compressor according to claim 1, wherein each of the first metal guide part and the second metal guide part has two lateral branches extending from the respective one of the first assembly portion and the second assembly portion and configured to guide the discharge check valve between the covering position and the released position.

10. The compressor according to claim 1, wherein the discharge valve comprises a return element configured to return the discharge check valve to the covering position.

11. A scroll refrigeration compressor, comprising a sealed enclosure at least partially delimiting a discharge chamber designed to be connected to a discharge line, and a discharge valve attached on the sealed enclosure and fluidly connected to the discharge chamber, the discharge valve comprising:

a valve body, a valve seat, a discharge check valve movable between a covering position, in which the discharge check valve bears against the valve seat, and a released position, in which the discharge check valve is remote from the valve seat, a guide device positioned in the valve body and configured to guide the discharge check valve between the covering position and the released position, the guide device including a first metal guide piece and a second metal guide piece respectively including a first assembly portion and a second assembly portion, the first assembly portion and the second assembly portion being substantially planar, the first assembly portion and the second assembly portion being separate structures, the first assembly portion being assembled and attached to the second assembly portion, the first metal guide piece and the second metal guide piece delimiting a housing configured to house the discharge check valve, and a deflector element positioned in the valve body and opposite the valve seat relative to the discharge check valve, the deflector element being configured to orient a flow of refrigerant coming from the discharge line at least partially toward the periphery of the discharge check valve, wherein at least one of the first metal piece and the second metal piece has at least one flap extending from the respective one of the first assembly portion and the second assembly portion, the at least one flap being monolithically integral with the respective one of the first assembly portion and the second assembly portion, the at least one flap at least partially forming the deflector element, and wherein the first assembly portion is attached to the second assembly portion so that the first assembly portion and the second assembly portion have a substantially cross-shaped transverse section.

12. A scroll refrigeration compressor, comprising a sealed enclosure at least partially delimiting a discharge chamber designed to be connected to a discharge line, and a discharge valve attached on the sealed enclosure and fluidly connected to the discharge chamber, the discharge valve comprising:

a valve body, a valve seat, a discharge check valve movable between a covering position, in which the discharge check valve bears against the valve seat, and a released position, in which the discharge check valve is remote from the valve seat, a guide device positioned in the valve body and configured to guide the discharge check valve between the covering position and the released position, the guide device including a first metal guide part and a second metal guide part delimiting a housing configured to house the discharge check valve, the first metal guide part including a first assembly portion and two lateral branches extending from the first assembly portion, the second metal guide part including a second assembly portion and two lateral branches extending from the second assembly portion, the first assembly portion and the second assembly portion being substantially planar, the first assembly portion being attached to the second assembly portion and the lateral branches of the first metal guide part and the second metal guide part being configured to guide the discharge check valve between the covering position and the released position, and a deflector element positioned in the valve body and opposite the valve seat relative to the discharge check valve, the deflector element being configured to orient a flow of refrigerant coming from the discharge line at least partially toward the periphery of the discharge check valve, wherein at least one of the at least first metal guide part and the second metal guide part has at least one flap extending from the respective one of the first assembly portion and the second assembly portion, the at least one flap being monolithically integral with the respective one of the first assembly portion and the second assembly portion, at least one flap at least partially forming the deflector element, and wherein the first assembly portion is attached to the second assembly portion so that the first assembly portion and the second assembly portion have a cross-shaped transverse section.

* * * * *